US010419853B2

(12) United States Patent
Hariharan et al.

(10) Patent No.: US 10,419,853 B2
(45) Date of Patent: Sep. 17, 2019

(54) BINAURAL AUDIO CAPTURE USING UNTETHERED WIRELESS HEADSET

(71) Applicant: Apple Inc., Cupertino, CA (US)

(72) Inventors: Sriram Hariharan, San Jose, CA (US); Baptiste P. Paquier, Saratoga, CA (US); Eric A. Allamanche, Sunnyvale, CA (US); Alon Paycher, Beit Hananya (IL)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/901,624

(22) Filed: Feb. 21, 2018

(65) Prior Publication Data

US 2019/0261089 A1 Aug. 22, 2019

(51) Int. Cl.

| | |
|---|---|
| ***H04R 5/04*** | (2006.01) |
| ***H04R 5/027*** | (2006.01) |
| ***H04R 5/033*** | (2006.01) |
| ***H04R 1/40*** | (2006.01) |
| ***H04S 1/00*** | (2006.01) |
| ***H04R 1/10*** | (2006.01) |

(52) U.S. Cl.

CPC ..... *H04R 5/04* (2013.01); *H04R 1/1016* (2013.01); *H04R 1/406* (2013.01); *H04R 5/027* (2013.01); *H04R 5/033* (2013.01); *H04S 1/007* (2013.01); *H04R 2420/07* (2013.01); *H04S 2400/15* (2013.01)

(58) Field of Classification Search

CPC ..... H04R 5/04; H04R 5/027; H04R 5/033; H04R 1/406; H04R 2420/07; H04S 1/007; H04S 2400/15

See application file for complete search history.

(56) References Cited

U.S. PATENT DOCUMENTS

| | | | |
|---|---|---|---|
| 8,831,255 | B2 | 9/2014 | Crawford et al. |
| 2004/0076301 | A1 | 4/2004 | Algazi et al. |

(Continued)

FOREIGN PATENT DOCUMENTS

| | | | |
|---|---|---|---|
| EP | 2416508 | A2 | 2/2012 |

OTHER PUBLICATIONS

Search Report for related GB Patent App No. GB1811414.0 dated Jan. 22, 2019 4 Pages.

(Continued)

*Primary Examiner* — Ping Lee

(74) *Attorney, Agent, or Firm* — Womble Bond Dickinson (US) LLP

(57) ABSTRACT

A wireless headset includes first and second wireless earphone devices, each including a microphone. The first earphone device assembles a first group of audio packets, each of which includes a first low-resolution clock value, a first high-resolution clock value, and a sequence of first microphone samples, and transmits the first plurality of audio packets to the second wireless earphone device, as a slave device of a first wireless network. The second earphone device receives the first group of audio packets from the first wireless earphone device, assembles a second group of audio packets, each of which includes a second low-resolution clock value, a second high-resolution clock value, and a sequence of second microphone samples, and transmits the first and second groups of audio packets to an external device. Other aspects are also described and claimed.

21 Claims, 3 Drawing Sheets

(56) References Cited

U.S. PATENT DOCUMENTS

| | | | | |
|---|---|---|---|---|
| 2012/0033620 | A1* | 2/2012 | Thoen | H04J 3/0697 370/329 |
| 2012/0328111 | A1 | 12/2012 | Cho et al. | |
| 2015/0110275 | A1 | 4/2015 | Tammi et al. | |
| 2015/0245129 | A1 | 8/2015 | Dusan et al. | |
| 2016/0359577 | A1 | 12/2016 | Bracha et al. | |
| 2018/0350405 | A1 | 12/2018 | Marco et al. | |

OTHER PUBLICATIONS

CC256x Dual-Mode Bluetooth Controller; Texas Instruments Incorporated; Mechanical, Packaging and Orderable Information; CC2560A NRND, CC2564 NRND; 2012-2016; 52 pages.
Masters and Slaves: Roles in a Bluetooth Piconet, by Jennifer Bay; Inform It; Prentice Hall Professional; 2001; 3 pages.
An Efficient Asynchronous Sampling-Rate Conversion Algorithm for Multi-Channel Audio Applications, by Paul Beckmann, Timothy Stilson; Audio Engineering Society Convention Paper; 119th Convention; 2005; 15 pages.
Clock Synchronization Issues in Bluetooth-Based Industrial Measurements, by Lucia Lo Bello, Orazio Mirabella; 2006 pp. 193-202.
Creating Audio Applications with Bluetooth A/V, by Jason Hillyard; WIDCOMM (Wireless Internet and Data/Voice Communications); Technical Paper / Conference Paper; 2006; 8 pages.
Bluetooth Baseband, by Marko Bundalo; 11129/2017; 6 pages; <http://ecee.coloradaedu/~ecen4242/marko/Bluetooth/Bluetooth/Specification/Baseband.htm>.
Bluetooth Clocks and CSP; epxx.co; Oct. 11, 2017; 2 pages; <https://epxx.co/artigos/bluetooth_csp_en.html>.
Bluetooth PANs; IEEE; 802.15; Dec. 11, 2017; 62 pages.
Bluetooth Accessory Design Guidelines for Apple Products; Apple Inc.; Jun. 16, 2017; 52 pages.
Cheep Sync: A Time Synchronization Service for Resource Constrained Bluetooth LE Advertisers, by S Srudhar, P. Misra, J Warrior; 2016; 10 pages.
Specification of the Bluetooth System; Specification vol. 0, v4.2; Master Table of Contents & Compliance Requirements; 2014; 2772 pages.
Bluetooth; Bluetooth Core Specification, v 5.0; Specification vol. 0; Master Table of Contents & Compliance Requirements; 2016; 2822 Pages.
Frequency Accuracy Stability Dependencies of Crystal Oscillators, by H Shou, C Nicholls, T Kunz, H Schwartz; Carleton University, Systems and Computer Engineering, Technical Report SCE-08-12, 2008; 15 Pages.
Health Device Profile, Implementation Guidance White paper; Medical Devices WG; Bluetooth Sig; 2009.
Ultra-low Power Stereo Audio Codec; Maxim integrated Products, MAX9867; 2010; 55 pages; <https://www.maximintegrated.com/en.html>.
Practical Time Synchronization for Bluetooth Scatternets, by Matthias Ringwald, Kay Romer; Fourth International Conference on Broadband Communications, Networks and Systems; 2007; 9 pages.
Simple Ways to Manage Different Clock Frequencies of Audio Codecs, by Carlos Azeredo-Leme; White Paper, Synopsys, predictable Success; 2011; 6 pages.
Special Focus: Understanding the IEEE 1588 Precision Time Protocol; National Instruments Nov. 6, 2015 <http://www.ni.com/newsletter/50130/en/>.
International Organisation for Standardisation Organisation Internationale De Normalisation ISO/IEC JTC1/SC29/ WG11 Coding of Moving Pictures and Audio; White paper on AAC Transport Formats, Audio Subgroup; 2014; 11 Pages.
Improving Bluetooth Network Performance Through a Time-Slot Leasing Approach, by Wensheng Zhang, Hao Zhu, and Guohong Cao; IEEE Wireless Communications and Networking Conference Record; 2002; 5 pages.

* cited by examiner

| L2CAP Header (2 bytes) | Packet Lentgh (2 bytes) | Packet Lentgh (2 bytes) | BT Clock (4 bytes) | Audio Clock (4 Bytes) | Audio Data (256/340 bytes) |
|---|---|---|---|---|---|

BINAURAL AUDIO CAPTURE USING UNTETHERED WIRELESS HEADSET

BACKGROUND

Field

Aspects of the disclosure here relate to the field of binaural audio recording; and more specifically, to ear mounted wireless microphone pairs for binaural audio recording from a pair of untethered wireless earphones.

Background

Recording 360 degree audio or capturing audio as seen by both ears (binaural) allows recreating sounds as heard by the user. Binaural recording is intended for replay using headphones and will not translate properly over stereo speakers. This type of audio recording when played back with a video recording enhances the viewing experience.

Binaural recording of a sound scene uses two microphones, arranged with the intent to subsequently create a 3-D stereo sound sensation for the listener, as if the listener were actually present in the sound scene. This effect may be created, by placing a pair of microphones spaced apart by the average distance between a listener's ears and separated by a device that provides the acoustic effects of the listener's head. While this is often done using a mannequin head outfitted with a microphone in each ear, it is also possible to place microphones in or near a person's ears, to make the binaural recording.

Personal digital devices, such as smartphones, often include the ability to make video recordings. Such devices may also be used with wireless in-ear audio devices that include both speakers and microphones (e.g., earbuds) allowing the user to perform functions such as listening to music and making telephone calls.

SUMMARY

It would be desirable to provide a way to use wireless in-ear audio devices, such as wireless earbuds, to make binaural recordings. An aspect of the disclosure here is a wireless headset that includes first and second wireless earphone devices, each including a microphone. Each wireless earphone device is "untethered" in the sense that it transmits its microphone signal (to another device that is separate from, and outside, its earphone housing) via a wireless or over the air communication link. The first earphone device assembles a first group of audio packets, each of which includes a first low-resolution clock value, a first high-resolution clock value, and a sequence of first microphone samples, and transmits the first group of audio packets to the second wireless earphone device; the latter is configured as master device of a first wireless network, while the former is configured as a slave device, of the first wireless network, that transmits the first group of audio packets. The second earphone device receives the first group of audio packets from the first wireless earphone device, assembles a second group of audio packets, each of which includes a second low-resolution clock value, a second high-resolution clock value, and a sequence of second microphone samples, and transmits the first and second groups of audio packets to an external device, while the latter is configured as a master device of a second wireless network.

Other features and advantages of the various aspects in the disclosure will be apparent from the accompanying drawings and from the detailed description that follows below.

BRIEF DESCRIPTION OF THE DRAWINGS

The disclosure here may best be understood by referring to the following description and accompanying drawings that are used to illustrate various aspects of the disclosure by way of example and not limitation. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect. In the drawings, in which like reference numerals indicate similar elements.

DETAILED DESCRIPTION

In the following description, numerous specific details are set forth. However, it is understood that embodiments of the aspects in the disclosure may be practiced without these specific details. In other instances, well-known circuits, structures and techniques have not been shown in detail in order not to obscure the understanding of this description.

In the following description, reference is made to the accompanying drawings, which illustrate several aspects. It is understood that other aspects may be utilized, and mechanical compositional, structural, electrical, and operational changes may be made without departing from the spirit and scope of the present disclosure. The following detailed description is not to be taken in a limiting sense, and the scope of the invention is defined only by the claims of the issued patent.

The terminology used herein is for the purpose of describing particular aspects only and is not intended to be limiting of those aspects. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, operations, elements, and/or components, but do not preclude the presence or addition of one or more other features, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, or operations (acts) are in some way inherently mutually exclusive.

Figure 1:
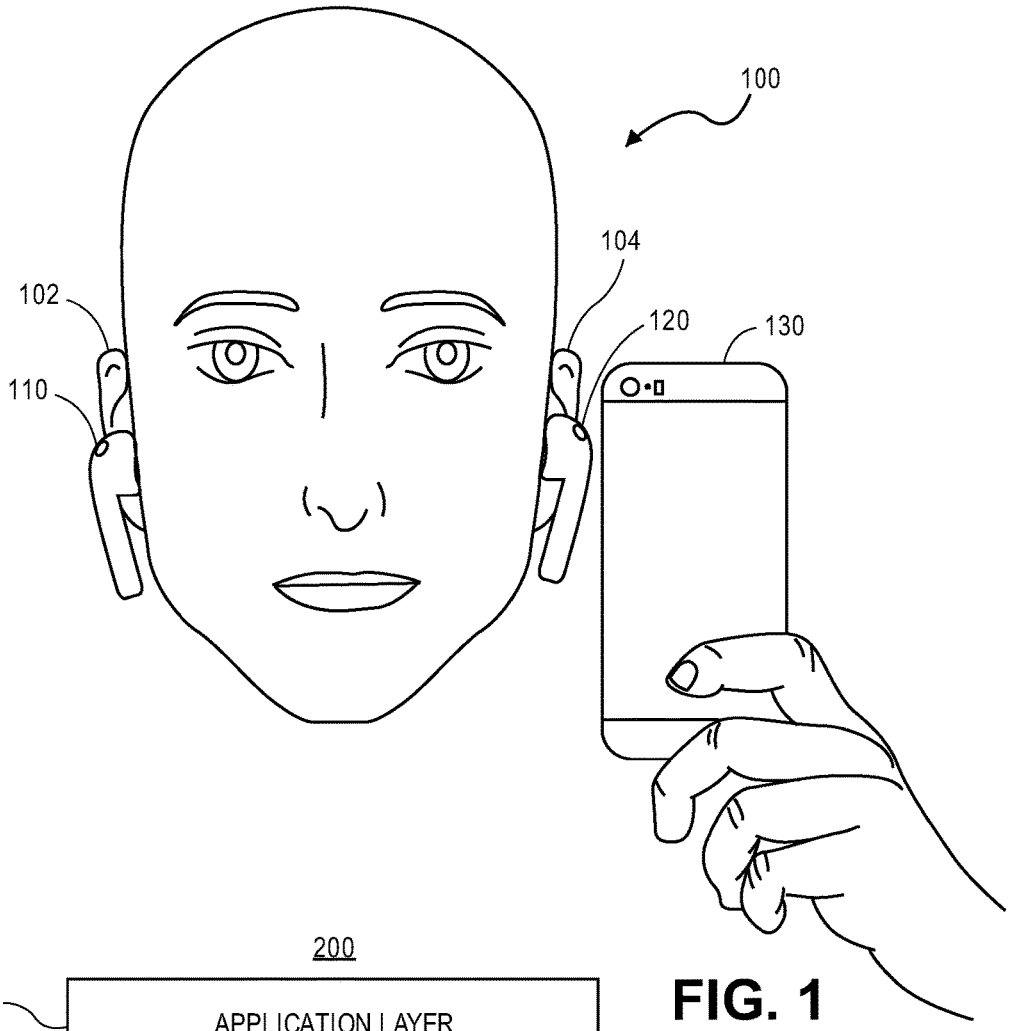
FIG. 1 is a pictorial view of an illustrative user wearing a wireless headset and holding an external device.

FIG. 1 is a pictorial view of an illustrative user 100 wearing a wireless headset that includes two wireless earphone devices 110, 120, and holding an external device 130. Each of the two wireless earphone devices 110, 120 may be worn in one of the user's ears 102, 104 respectively. Each of the two wireless earphone devices 110, 120 includes one or more microphones. When the two wireless earphone devices 110, 120 are worn in the user's ears 102, 104, the microphones are suitably arranged for binaural audio recording.

The wireless headset may communicate with the external device 130 via a wireless connection. Further, each of the two wireless earphone devices 110, 120 may communicate with each other via a second wireless connection. Wireless connections occur through the air (no physical connection is needed). Wireless protocols may, for example, be based on short range transmissions of voice and/or data. The wireless protocols may further be used to create personal area networks between the headset and a nearby external device such as a cellular phone or a tablet computer. Some examples of wireless protocols that can be used include Bluetooth, Home RF, iEEE 802.11, IrDA, Wireless USB, and the like. The communication electronics may be embodied as a system on a chip (SOC).

Although other wireless protocols may be used, according to one aspect of the disclosure, each of the two wireless earphone devices 110, 120 of the wireless headset may include wireless communication electronics that is based on the Bluetooth protocol. The communication electronics may, for example, include or correspond to a Bluetooth System-on-a-Chip (SoC). The SoC can include circuitry for performing functions other than wireless communications. For example, in some embodiments, circuitry for communicating using wired Universal Serial Bus (USB) interfaces and conventional serial interfaces can also be integrated into the SoC. While it is understood that the disclosure may be practiced using other wireless protocols, the disclosure will be described based on the use of the Bluetooth wireless protocol.

The fundamental basics of the Bluetooth protocol are discussed briefly below. Bluetooth protocol allows intelligent devices to communicate with each other through wireless, low power, short-range communications. This technology allows electronic equipment to make its own connections, without wires or any direct action from a user.

Bluetooth protocol can be referred to as a frequency hopping spread spectrum (FHSS) radio system that operates in the 2.4 GHz unlicensed band. Bluetooth protocol wireless transmissions change frequencies based on a sequence which is known to both the transmitter and the receiver. According to one known technique, Bluetooth wireless transmissions use 79 different frequencies ranging from 2.404 GHz to 2.480 GHz. The transmissions may be low power transmissions which only allow a typical range of about 10 meters or roughly 30-40 feet. But the possible range can vary from about 1 meter to 100 meters depending on the amount of power used by the device for Bluetooth wireless transmissions.

Bluetooth devices connect to each other to form networks known as piconets. A piconet includes two or more devices whose internal clocks are synchronized to a common clock signal and that use a common hopping sequence. Thus, for any device to connect to a given piconet, that device may need to have the same clock signal and the same hopping sequence. The clock and hopping sequence in each device can be derived using the clock signal of one of the devices on the piconet.

The terminology "master device" will be used for the device that initiates a Bluetooth connection and/or maintains a piconet (a wireless network) with one or more Bluetooth devices. The terminology "slave device" will be used for the device that responds to the initiating master device and/or is a subordinate unit of the piconet after it has been established. Each piconet can include one master device and a number of slave devices. Moreover, Bluetooth devices can belong to more than one piconet. The term "scatternet" is used to define Bluetooth networks which are made up of multiple, overlapping piconets. In the case where one Bluetooth device is on two piconets, all of the devices on the two piconets are on a single scatternet. Devices from one of the piconets can communicate with devices from another piconet by using the shared device to relay the signals.

When two Bluetooth devices initially connect, the slave device synchronizes its local clock to the clock of the master device. These clocks tick at 312.5 μs intervals. Two clock ticks make up a slot of 625 μs, and two slots make up a slot pair of 1250 μs. In the simple case of single-slot packets the master transmits in even slots and receives in odd slots. The slave, conversely, receives in even slots and transmits in odd slots. Packets may be 1, 3 or 5 slots long, but in all cases the master's transmission begins in even slots and the slave's in odd slots. The Bluetooth clock is a 28-bit counter that increments at 312.5 μs intervals and has a mandatory maximal drift of ±20 ppm. For the purposes of this description the clocks that are synchronized between master and slave devices to control the transmission slots will be called low-resolution clocks.

Bluetooth devices can operate with a data throughput of approximately 2.1 Mbit/s (Megabits-per-second), but it is understood that other data rates are or may become, available as technology advances, and that aspects of the disclosure may operate at other rates. This data throughput is shared among all devices on a piconet, meaning that the sum of all communications by all devices in the piconet is less than the maximum data throughput for the piconet.

Figure 2:
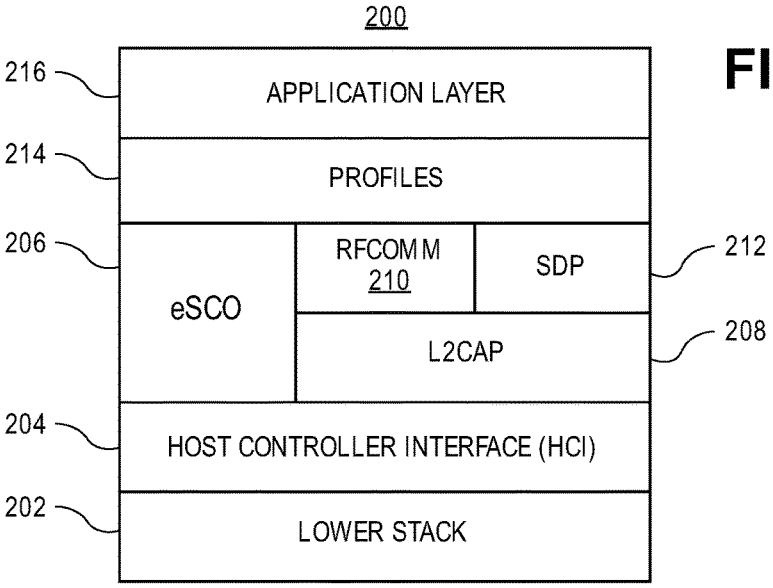
FIG. 2 is a simplified schematic diagram of an exemplary Bluetooth Protocol Stack.

The Bluetooth Specification includes a published software framework. The framework is called the Bluetooth Protocol Stack and includes different software applications to implement Bluetooth communications. FIG. 2 is a simplified schematic diagram of an exemplary Bluetooth Protocol Stack 200. Low-level software is included in Lower Stack 202. This section includes code to generate/receive radio signals, correct transmission errors and encrypt/decrypt transmissions, among other things. The Host Controller Interface (HCI) 204 is an interface between the low-level Bluetooth functions and the applications. The HCI layer represents a division between the Lower Stack 202 functions that may be handled by a dedicated Bluetooth processor and the rest of the functions that may be handled by an application-specific processor.

The Extended Synchronous Connection-Oriented (eSCO) 206 layer is used to implement dedicated communication channels, commonly used for voice data, in between the Lower Stack 202 and high-level applications. The Logical Link Control and Adaptation Protocol (L2CAP) 208 layer combines and repackages the data transmitted and received by the multiple higher-level applications. The L2CAP 208 layer combines all of these different communications into one data stream that can interface with Lower Stack 202. The RFCOMM 210 layer emulates the protocol used by serial connections. This allows software designers to easily integrate Bluetooth capability into existing applications which previously used a serial connection. The Service Discovery Protocol (SDP) 212 layer is used by devices to provide information about what services (or functions) each device offers and how other devices can access those services through Bluetooth protocol.

The Profiles layer (Profiles 214) allows a device to identify itself as a member of a generic group of devices with a predefined set of functions. For example, a device complying with the headset profile may support predefined methods relating to audio communications. The Application Layer 216 contains programs that implement the useful tools created by all of the other layers. By writing different programs for Application Layer 216, software developers can focus on new uses of the Bluetooth functionality without having to rewrite the code which controls the underlying communication tasks.

Figure 3:
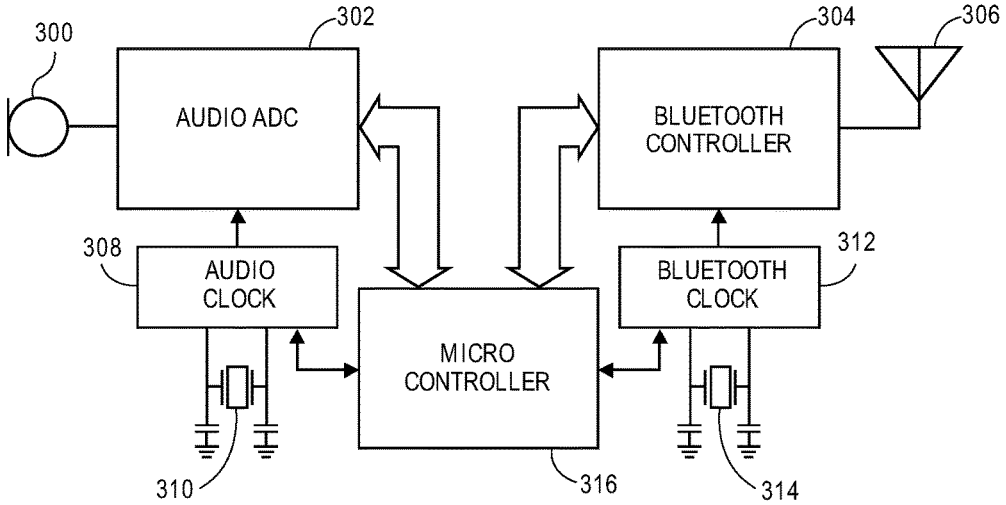
FIG. 3 is a simplified and exemplary block diagram of a circuit that may be included in each of the two wireless earphone devices.

FIG. 3 is a simplified and exemplary block diagram of a circuit that may be included in each of the two wireless earphone devices 110, 120—see FIG. 1. The elements shown in FIG. 3 may be integrated into each wireless earphone housing. A micro controller 316 may be communicatively coupled to an audio analog to digital converter (ADC) 302 and to a wireless transceiver 304 (e.g., a Bluetooth controller.) The micro controller 316 and the transceiver 304 may each include a processor (collectively referred to as "a processor") that may be part of a Bluetooth System-on-a-Chip (SoC). The audio analog to digital converter (ADC) 302 may be part of an audio codec that also includes an audio digital to analog converter (DAC) to provide coding of audio both from an analog format to a digital format and vice versa.

The audio ADC 302 is coupled to an audio clock 308, which may have a frequency controlled by a crystal oscillator 310 or by other means of providing a high precision frequency reference. The audio clock 308 determines the rate at which an audio signal is sampled to provide a series of digital values that represent the audio signal. The crystal oscillator 310 may operate at a high frequency that can be divided by a variety of values to provide a selection of audio sample rates. For example, the oscillator may operate at 3.072 MHz and the audio clock 308 divides the oscillator 310 frequency by 64 to get a 48 kHz audio sample rate that provides a digital value of the audio signal every 20.833 μs. For the purposes of this description the clocks that control the audio sampling rates will be called high-resolution clocks (audio clock 308.) The high-resolution clocks update their counts more frequently than the low-resolution clocks (described as above being used for controlling the transmission slots).

The high-resolution clocks of the first and second wireless earphone devices 110, 120 may be configured to operate at the same nominal frequency; also, the low-resolution clocks of the first and second wireless earphone devices may be configured to operate at the same nominal frequency. This happens while the wireless earphone devices are capturing binaural audio signals. The same nominal frequency is used to mean that the frequency is a stated nominal value with a variation that is typical for the type of oscillator used to control the clock frequency and the purpose for which the clock is used. For example, the low-resolution clock operates at a nominal frequency of 3200 Hz±20 ppm when the Bluetooth wireless protocol is being used. The high-resolution clock used for audio sampling may operate at a nominal frequency of 48 kHz±50 ppm, for example. It will be appreciated that both the low- and high-resolution clocks may drift in relation to one another and in relation to the low- and high-resolution clocks in the other wireless earphone device. It is necessary to compensate for clock drifts to provide a binaural audio signal with an acceptable quality.

Still referring to FIG. 3, a microphone 300 may be coupled to an audio encoder, such as the audio ADC 302. The audio ADC 302 produces a stream of digital values at a rate controlled by the high-resolution audio clock 308 that represent microphone samples of the audio pressures waves impinging on the microphone 300.

The microphone samples may be communicated to the microcontroller 316 to be assembled into audio packets. The microcontroller 316 may communicate the audio packets to a wireless transceiver 304, such as a Bluetooth controller, that provides wireless transmission via an antenna 306 in the wireless earphone device, to be wirelessly communicated to another device, such as the other wireless earphone device or an external device. A low-resolution clock (transmission clock 312) controls the wireless transmission of the audio packets, e.g., the transmission slots.

Referring briefly back to FIG. 1, the first wireless earphone device 110 includes a first microphone, a first wireless transceiver, and a first processor, and is configured to be worn in a first ear 102 of the user 100. The second wireless earphone device 120 includes a second microphone, a second wireless transceiver, and a second processor, and is configured to be worn in a second ear 104 of the user 100. Each of the circuits including a microphone, a wireless transceiver, and a processor in the wireless earphone devices may be as described above and shown in FIG. 3.

The first and second wireless earphone devices 110, 120 produce first and second audio signals, respectively, based on sound arriving at the ear 102, 104, respectively, in which they are being worn. It will be appreciated that the first wireless earphone device 110 and the second wireless earphone device 120 may differ only in their external shapes, which are configured to be worn in a particular ear 102, 104 of the user 100. The first wireless earphone device 110 and the second wireless earphone device 120 may exchange roles when in use, for example the first wireless earphone device 110 becoming the second wireless earphone device 120 and vice versa.

When used to record binaural audio, one of the two wireless earphone devices shown in FIG. 1 assumes the role of device A and the other assumes the role of device B. The A, B roles of the earphone devices may be selected based on the respective qualities of wireless communication. For example, if the wireless earphone device that is in the left ear has a better communication link (e.g., more reliable, faster, or lower power consumption) with the external device 130 than has the wireless earphone device that is in the right ear, than the left device may assume the role of device B (and the right device assumes the role of device A.) Other methods of determining the A, B roles of the earphone devices may be used.

Figure 6:
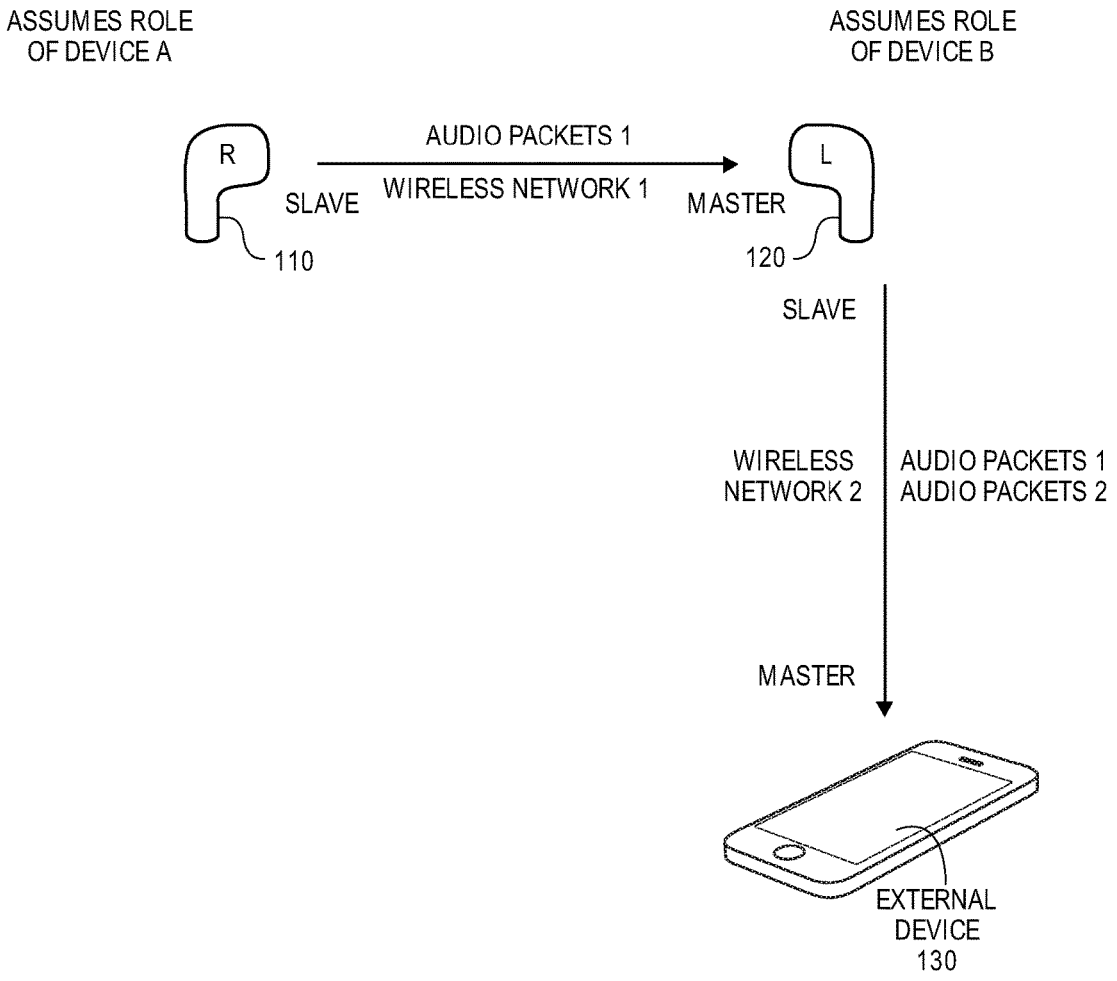
FIG. 6 illustrates an example of how a pair of left and right wireless earphones configured into their roles as device A and device B communicate their respective audio packets.

Referring now to FIG. 6, the wireless earphone device that assumes the role of device B serves as the master device for a first piconet that includes the other wireless earphone device (which assumes the role of device A) as a slave device. For the purposes of this description, it will be assumed that the wireless earphone device 110 worn in the right ear 102 of the user 100 has assumed the role of device A and that the wireless earphone device 120 worn in the left ear 104 of the user has assumed the role of device B. It is understood that these roles could be reversed.

As shown in FIG. 6, in addition to being the master device in the first piconet, the second wireless earphone device 120 also serves as a slave device in a second piconet that includes an external device 130 as a master device. The first and second piconets form a scatternet in which the second wireless earphone device 120 serves as a bridge device that can forward communications between the first wireless earphone device 110 and the external device 130. It will be appreciated that the communication timing in the second piconet is controlled by its master device, which is the external device 130. Likewise, the communication timing in the first piconet is controlled by its master device, which is the second wireless earphone device 120.

Figure 4:
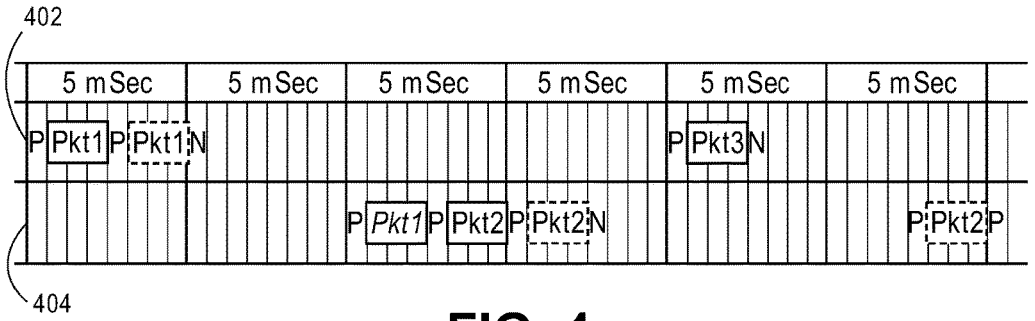
FIG. 4 is an exemplary timing for packets being communicated on a first and a second piconet.

FIG. 4 shows an exemplary timing for packets Pkt1, Pkt3 being communicated from the first wireless earphone device 110 to the second wireless earphone device 120 on the first piconet 402. That figure also shows example timing for packets Pkt1, Pkt2 being communicated from the second wireless earphone device 120 to the external device 130 on the second piconet 404. The second wireless earphone device 120 will transition between its role as a master device on the first piconet and its role as a slave device on the second piconet. To reduce communication delays, the second wireless earphone device 120 may synchronize its low-resolution clock (transmission clock 312—see FIG. 3) with a low-resolution clock of the external device 130 and then use the resulting, synchronized low-resolution clock as the master clock for transmissions in the first piconet.

For the purposes of this description "synchronized" is used to indicate that the rates of the synchronized clocks are controlled so that the phase relationship between the synchronized clocks remains within a small range. A deliberate phase difference may be maintained by the second wireless earphone device 120 between the master clock of the second piconet, as established by the external device, and the master clock of the first piconet that the second wireless earphone device establishes, so that the second wireless earphone device can switch between communicating on the first and second piconets within much less than one clock period of the wireless communication.

Figure 5:
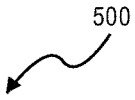
FIG. 5 is an exemplary audio data packet structure.

FIG. 5 shows an exemplary audio data packet structure 500 that may be used to wirelessly communicate audio packets that include audio data based on microphone samples. The first wireless earphone device 110 is configured to assemble a first group of audio packets, each of which includes a first low-resolution clock value (BT clock (4 Bytes), from the transmission clock 312 in FIG. 3), a first high-resolution clock value (audio clock (4 Bytes), from the audio clock 308), and a sequence of first microphone samples (audio data (256/340 Bytes) for the microphone included in the first wireless earphone device. The first wireless earphone device 110 is further configured to transmit the first group of audio packets to the second wireless earphone device 120, where the first wireless earphone device 110 does so as a slave device of a first wireless network, such as the first piconet 402 (see FIG. 4.)

As a master device of the first wireless network, the second wireless earphone device 120 is configured to receive the first group of audio packets from the first wireless earphone device 110. The second wireless earphone device 120 is further configured to assemble a second plurality of audio packets, each of which includes a second low-resolution clock value (BT clock (4 Bytes)), a second high-resolution clock value (audio clock (4 Bytes)), and a group of second microphone samples for the microphone included in the second wireless earphone device. The second low-resolution clock value (BT clock) may be based on a second low-resolution clock (transmission clock 312 in the second wireless earphone device) that controls packet transmissions by the second wireless transceiver (a wireless transceiver 304 in the second wireless earphone device 120), and the first low-resolution clock value is based on a first low-resolution clock (transmission clock 312 in the first wireless earphone device) that is periodically synchronized with the second low-resolution clock and which controls packet transmissions by the first wireless transceiver (a wireless transceiver 304 in the first wireless earphone device 110). The second low-resolution clock may be periodically synchronized with an external low-resolution clock that controls packet transmissions by an external wireless transceiver included in the external device 130.

The second wireless earphone device 120 may use the low-resolution clock values to appropriately pair audio packets from the first group of audio packets (received from the first wireless earphone device 110) with audio packets from the second group of audio packets that the second wireless earphone device assembles. The second wireless earphone device 120 is further configured to transmit the pairs of first and second audio packets to the external device 130 as a slave device of a second wireless network, such as the second piconet 404. In other words, the first and second audio packets are transmitted along with information that identifies the pairs, where each pair refers to a selected one (packet) of the first audio packets and a selected one (packet) of the second audio packets that may be deemed to be in synch with each other.

The low-resolution clock values in the pairs of first and second audio packets may be synchronized by the wireless communication protocol. The first high-resolution audio clock may be periodically synchronized with the first low-resolution clock, and the second high-resolution audio clock may be periodically synchronized with the second low-resolution clock.

The high-resolution audio clocks 308 that control the sampling rates in each of the wireless earphone devices 110, 120 may drift with respect to one another to the extent that the first wireless earphone device 110 may gain or lose an audio sample as compared to the second wireless earphone device 120. The second wireless earphone device 120 may use the high-resolution clock values to appropriately adjust the audio data in the first and/or second audio packets to maintain synchronization between the audio data acquired from the first and second wireless earphone devices 110, 120 (prior to transmitting the first and second audio packets to the external device.) For example, the second wireless earphone device 120 may add or remove an audio sample from a second audio packet, and adjust its second high-resolution audio clock 308 to resynchronize the audio samples from the microphone in the second wireless earphone device with the audio samples from the microphone in the first wireless earphone device 110.

Although particular aspects have been described above in detail and shown in the accompanying drawings, it will be understood that this description is merely for purposes of illustration. Alternative aspects of those described herein are also within the scope of the present invention. For example, while one aspect can include a Bluetooth headset, one or more features of the disclosure here can also be incorporated into headsets employing other wireless communication protocols. Also, while some aspects can include headsets configured for communication with a cellular phone and/or personal media device, one or more features of the disclosure can also be incorporated into headsets configured for communication with any electronic device. It is to be understood that such features are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A wireless headset comprising:

a first wireless earphone device that includes a first microphone; and a second wireless earphone device that includes a second microphone;

wherein the first wireless earphone device is configured to assemble a first plurality of audio packets, each of which includes a first low-resolution clock value, a first high-resolution clock value, and a plurality of first microphone samples, and transmit, as a slave device of a first wireless network, the first plurality of audio packets to the second wireless earphone device;

wherein the second wireless earphone device is configured to receive, as a master device of the first wireless network, the first plurality of audio packets from the first wireless earphone device, assemble a second plurality of audio packets, each of which includes a second low-resolution clock value, a second high-resolution clock value, and a plurality of second microphone samples, and transmit, as a slave device of a second wireless network, the first plurality of audio packets and the second plurality of audio packets to an external device.

2. The wireless headset of claim 1, wherein the second low-resolution clock value is based on a second low-resolution clock that controls packet transmissions by a second wireless transceiver, and the first low-resolution clock value is based on a first low-resolution clock that i) is periodically synchronized with the second low-resolution clock and ii) controls packet transmissions by a first wireless transceiver.

3. The wireless headset of claim 2, wherein the second low-resolution clock is periodically synchronized with an external low-resolution clock that controls packet transmissions by an external wireless transceiver included in the external device.

4. The wireless headset of claim 2, wherein:

the first wireless earphone device further includes a first audio encoder that receives a signal from the first microphone and produces the plurality of first microphone samples at a rate controlled by a first audio clock; and the second wireless earphone device further includes a second audio encoder that receives a signal from the second microphone and produces the plurality of second microphone samples at a rate controlled by a second audio clock;

wherein the first high-resolution clock value is based on the first audio clock and the second high-resolution clock value is based on the second audio clock.

5. The wireless headset of claim 4, wherein the first audio clock is periodically synchronized with the first low-resolution clock, and the second audio clock is periodically synchronized with the second low-resolution clock.

6. The wireless headset of claim 2, wherein:

the first wireless earphone device further includes a first wireless transceiver that is configured as the slave device of the first wireless network to transmit the first plurality of audio packets to the second wireless earphone device;

the second wireless earphone device further includes a second wireless transceiver that is configured as the master device of the first wireless network to receive the first plurality of audio packets from the first wireless earphone device, and that is configured as the slave device of the second wireless network to transmit the first plurality of audio packets and the second plurality of audio packets to the external device.

7. The wireless headset of claim 1, wherein the first wireless earphone device is configured to be worn in a first ear of a user, and the second wireless earphone device is configured to be worn in a second ear of the user, such that the first microphone produces a first audio signal based on sound arriving at the first ear, and the second microphone produces a second audio signal based on sound arriving at the second ear.

8. A method of transmitting audio from microphones in a wireless headset, the method comprising:

assembling a first plurality of audio packets, each of which includes a first low-resolution clock value, a first high-resolution clock value, and a plurality of first microphone samples from a first microphone in a first wireless earphone device;

transmitting, as a slave device of a first wireless network, the first plurality of audio packets to a second wireless earphone device;

receiving the first plurality of audio packets from the first wireless earphone device by a second wireless earphone device acting as a master device of the first wireless network;

assembling a second plurality of audio packets, each of which includes a second low-resolution clock value, a second high-resolution clock value, and a plurality of second microphone samples from a second microphone in the second wireless earphone device; and transmitting the first plurality of audio packets and the second plurality of audio packets to an external device by the second wireless earphone device acting as a slave device of a second wireless network.

9. The method of claim 8, wherein the second low-resolution clock value is based on a second low-resolution clock that controls packet transmissions by a second wireless transceiver included in the second wireless earphone device, and the first low-resolution clock value is based on a first low-resolution clock included in the first wireless earphone device that is periodically synchronized with the second low-resolution clock and which controls packet transmissions by the first wireless transceiver.

10. The method of claim 9, wherein second low-resolution clock is periodically synchronized with an external low-resolution clock that controls packet transmissions by an external wireless transceiver included in the external device.

11. The method of claim 9, further comprising:

encoding a signal from the first microphone to produce the plurality of first microphone samples at a rate controlled by a first audio clock; and encoding a signal from the second microphone to produce the plurality of second microphone samples at a rate controlled by a second audio clock;

wherein the first high-resolution clock value is based on the first audio clock and the second high-resolution clock value is based on the second audio clock.

12. The method of claim 11, further comprising:

periodically synchronizing the first audio clock with the first low-resolution clock; and periodically synchronizing the second audio clock with the second low-resolution clock.

13. A wireless headset comprising:

a first processor to assemble a first plurality of audio packets, each of which includes a first low-resolution clock value, a first high-resolution clock value, and a plurality of first microphone samples from a first microphone in a first wireless earphone device;

a first wireless transceiver to transmit, as a slave device of a first wireless network, the first plurality of audio packets to a second wireless earphone device;

a second wireless transceiver to receive, in a second wireless earphone device and while acting as a master of the first wireless network, the first plurality of audio packets from the first wireless earphone device; and a second processor to assemble a second plurality of audio packets, each of which includes a second low-resolution clock value, a second high-resolution clock value, and a plurality of second microphone samples from a second microphone in the second wireless earphone device, wherein the second wireless transceiver is to transmit, while acting as a slave device of a second wireless network, the first plurality of audio packets and the second plurality of audio packets to an external device.

14. The wireless headset of claim 13, wherein the second low-resolution clock value is based on a second low-resolution clock that controls packet transmissions by the second wireless transceiver included in the second wireless earphone device, and the first low-resolution clock value is based on a first low-resolution clock included in the first wireless earphone device that is periodically synchronized with the second low-resolution clock and which controls packet transmissions by the first wireless transceiver.

15. The wireless headset of claim 14, wherein the second low-resolution clock is periodically synchronized with an external low-resolution clock that controls packet transmissions by an external wireless transceiver included in the external device.

16. The wireless headset of claim 14, further comprising:

a first audio codec to produce the plurality of first microphone samples from a signal from the first microphone at a rate controlled by a first audio clock; and a second audio codec to produce the plurality of second microphone samples from a signal from the second microphone at a rate controlled by a second audio clock;

wherein the first high-resolution clock value is based on the first audio clock and the second high-resolution clock value is based on the second audio clock.

17. The wireless headset of claim 16, wherein the first processor synchronizes the first audio clock with the first low-resolution clock, and wherein the second processor synchronizes the second audio clock with the second low-resolution clock.

18. A wireless earphone device comprising a wireless earphone housing having therein:

a microphone;

a wireless transceiver to receive from another wireless earphone device over a first wireless network a first plurality of audio packets, wherein each of the first plurality of audio packets includes a first low-resolution clock value, a first high-resolution clock value, and a plurality of first microphone samples; and a processor to assemble a second plurality of audio packets, each of which includes a second low-resolution clock value, a second high-resolution clock value, and a plurality of second microphone samples from the microphone, wherein the wireless transceiver is to transmit the first plurality of audio packets and the second plurality of audio packets to an external device over a second wireless network.

19. The wireless earphone device of claim 18 wherein the wireless transceiver is to receive the first plurality of audio packets while acting as a master of the first wireless network, and to transmit the first plurality of audio packets and the second plurality of audio packets while acting as a slave device of the second wireless network.

20. The wireless earphone device of claim 18 wherein the second low-resolution clock value is based on a second low-resolution clock that controls packet transmissions by the wireless transceiver, and the first low-resolution clock value is based on a first low-resolution clock included in said another wireless earphone device that is periodically synchronized with the second low-resolution clock and which controls packet transmissions by a wireless transceiver in said another wireless earphone device.

21. The wireless earphone device of claim 20 wherein the processor uses a first high-resolution clock value and a second high-resolution clock value to adjust the audio data in one of the first audio packets or the second audio packets to maintain synchronization between the audio data acquired from the wireless earphone device and from said another wireless earphone device, prior to the first and second audio packets being transmitted to the external device.

* * * * *